US009207047B2

(12) United States Patent
Penn

(10) Patent No.: US 9,207,047 B2
(45) Date of Patent: Dec. 8, 2015

(54) ANTI-BALLISTIC PROTECTIVE ASSEMBLIES

(76) Inventor: Oded Penn, Ramat Hasharon (IL)

( * ) Notice: Subject to any disclaimer, the term of this patent is extended or adjusted under 35 U.S.C. 154(b) by 0 days.

(21) Appl. No.: 14/003,301

(22) PCT Filed: Mar. 7, 2012

(86) PCT No.: PCT/IL2012/000112

§ 371 (c)(1),
(2), (4) Date: Nov. 19, 2013

(87) PCT Pub. No.: WO2012/120503

PCT Pub. Date: Sep. 13, 2012

(65) Prior Publication Data

US 2014/0069269 A1 Mar. 13, 2014

(51) Int. Cl.

| | |
|---|---|
| ***F41H 5/08*** | (2006.01) |
| ***F41H 5/04*** | (2006.01) |
| ***F41H 5/013*** | (2006.01) |
| ***F41H 5/24*** | (2006.01) |
| ***F41H 7/02*** | (2006.01) |

(52) U.S. Cl.

CPC ..... *F41H 5/0414* (2013.01); *F41H 5/013* (2013.01); *F41H 5/04* (2013.01); *F41H 5/0435* (2013.01); *F41H 5/0442* (2013.01); *F41H 5/0478* (2013.01); *F41H 5/08* (2013.01); *F41H 5/24* (2013.01); *F41H 7/02* (2013.01)

(58) Field of Classification Search

CPC ..... A42B 3/063; A42B 3/12; F41H 5/08; F41H 5/04; F41H 5/0421

USPC ..... 89/36.01, 36.02, 36.05; 2/2.5, 455; 428/911; 109/49.5

See application file for complete search history.

(56) References Cited

U.S. PATENT DOCUMENTS

| | | | | |
|---|---|---|---|---|
| 4,351,870 | A * | 9/1982 | English, Jr. | 428/174 |
| 4,876,941 | A * | 10/1989 | Barnes et al. | 89/36.02 |
| 6,282,724 | B1 * | 9/2001 | Abraham et al. | 2/412 |
| 7,608,322 | B2 * | 10/2009 | Thurau et al. | 428/297.1 |
| 8,215,360 | B2 * | 7/2012 | Pettersen et al. | 156/382 |
| 8,322,268 | B1 * | 12/2012 | Booher, Sr. | 89/36.02 |
| 8,939,058 | B1 * | 1/2015 | Ecalono | 89/36.05 |
| 2007/0224401 | A1 * | 9/2007 | Telander | 428/212 |
| 2008/0314497 | A1 * | 12/2008 | Pettersen et al. | 156/62.2 |
| 2010/0043630 | A1 * | 2/2010 | Sayre et al. | 89/36.02 |
| 2011/0189430 | A1 * | 8/2011 | Cook et al. | 428/116 |
| 2011/0212320 | A1 * | 9/2011 | Greenhill et al. | 428/313.3 |
| 2012/0152096 | A1 * | 6/2012 | Peters | 89/36.01 |
| 2012/0291621 | A1 * | 11/2012 | Sayre et al. | 89/36.02 |
| 2013/0340147 | A1 * | 12/2013 | Giles | 2/412 |
| 2014/0099472 | A1 * | 4/2014 | Greenhill et al. | 428/147 |
| 2014/0144102 | A1 * | 5/2014 | Chen | 52/782.1 |
| 2014/0298656 | A1 * | 10/2014 | Ehsani | 29/897 |

* cited by examiner

*Primary Examiner* — Michael David

(74) *Attorney, Agent, or Firm* — Vorys, Sater, Seymour and Pease LLP

(57) ABSTRACT

Provided is an anti-ballistic protective assembly including a plurality of layers of anti-ballistic material including at least two types of anti-ballistic materials, and an enclosure which is at least partially injection molded over the plurality of layers of anti-ballistic material and retains the plurality of layers of anti-ballistic material in a mutually compressed operative orientation.

23 Claims, 7 Drawing Sheets

SECTION A–A
200
202
204
228
226
229
A
A
228
TO VACUUM PUMP
224

229
228
226
224
200
220
220
TO VACUUM PUMP

ANTI-BALLISTIC PROTECTIVE ASSEMBLIES

FIELD OF THE INVENTION

The present invention relates to anti-ballistic protection generally and more particularly to anti-ballistic protective assemblies and methods of manufacture thereof.

BACKGROUND OF THE INVENTION

The following patent publications are believed to represent the current state of the art:

U.S. Pat. Nos. 5,970,843; 6,537,654; 6,709,736 and 7,598,185; and

US Published Patent Application Nos: 2007/0089597; 2007/0105706 and 2008/0095958.

SUMMARY OF THE INVENTION

The present invention seeks to provide improved anti-ballistic protective assemblies and methods of manufacture thereof.

There is thus provided in accordance with a preferred embodiment of the present invention an anti-ballistic protective assembly including a plurality of layers of anti-ballistic material including at least two types of anti-ballistic materials, and an enclosure which is at least partially injection molded over the plurality of layers of anti-ballistic material and retains the plurality of layers of anti-ballistic material in a mutually compressed operative orientation.

In accordance with a preferred embodiment of the present invention, the enclosure includes a first enclosure element and a second enclosure element integrally molded with the first enclosure element. Preferably, the first enclosure element is formed with a curved back portion. Preferably, the first enclosure element is formed with a raised peripheral edge. Additionally, the plurality of layers of anti-ballistic material is positioned within the first enclosure element.

Preferably, the plurality of layers of anti-ballistic material includes layers of unidirectional polyethylene. Preferably, the plurality of layers of anti-ballistic material includes at least one ceramic plate. Preferably, at least one side of the at least one ceramic plate is coated with a layer of Kevlar®. Additionally or alternatively, at least one side of the at least one ceramic plate is coated with a layer of fiberglass.

Additionally or alternatively, the plurality of layers of anti-ballistic material includes at least one steel plate. Preferably, at least one side of the at least one steel plate is coated with a layer of Kevlar®. Additionally or alternatively, at least one side of the at least one steel plate is coated with a layer of fiberglass.

Preferably, the assembly also includes a protective vest, wherein the enclosure is inserted into a pocket of the protective vest. Additionally or alternatively, the enclosure is mounted in close proximity to an exterior of a motor vehicle. Additionally or alternatively, the enclosure is mounted in close proximity to an exterior of a stationary structure.

There is also provided in accordance with another preferred embodiment of the present invention an anti-ballistic protective assembly including a plurality of layers of anti-ballistic material including at least two types of anti-ballistic materials, and an enclosure which is at least partially vacuum formed over the plurality of layers of anti-ballistic material and retains the plurality of layers of anti-ballistic material in a mutually compressed operative orientation.

In accordance with a preferred embodiment of the present invention, the enclosure includes a first enclosure element and a second enclosure element which is heat welded to the first enclosure element. Preferably, the first enclosure element is formed with a curved back portion. Preferably, the first enclosure element is formed with a raised peripheral edge. Additionally, the plurality of layers of anti-ballistic material is positioned within the first enclosure element.

Preferably, the plurality of layers of anti-ballistic material includes layers of unidirectional polyethylene. Preferably, the plurality of layers of anti-ballistic material includes at least one ceramic plate. Preferably, at least one side of the at least one ceramic plate is coated with a layer of Kevlar®. Additionally or alternatively, at least one side of the at least one ceramic plate is coated with a layer of fiberglass.

Additionally or alternatively, the plurality of layers of anti-ballistic material includes at least one steel plate. Preferably, at least one side of the at least one steel plate is coated with a layer of Kevlar®. Additionally or alternatively, at least one side of the at least one steel plate is coated with a layer of fiberglass.

Preferably, the assembly also includes a protective vest, wherein the enclosure is inserted into a pocket of the protective vest. Additionally or alternatively, the enclosure is mounted in close proximity to an exterior of a motor vehicle. Additionally or alternatively, the enclosure is mounted in close proximity to an exterior of a stationary structure.

There is further provided in accordance with yet another preferred embodiment of the present invention a method of manufacturing an anti-ballistic protective assembly including providing a first enclosure element, positioning various layers of anti-ballistic protective materials in association with the first enclosure element into a cavity of a injection molding machine, and operating the injection molding machine to injection mold a second enclosure element integrally with first enclosure element and to compress the various layers of anti-ballistic protective material and to define an enclosure therefor, which retains the various layers of protective material in a compressed state in very tight mutual engagement.

In accordance with a preferred embodiment of the present invention, the method also includes preheating the first enclosure element prior to the positioning various layers of anti-ballistic protective materials in association therewith. Preferably, the method also includes mutually compressing the various layers of anti-ballistic protective materials prior to the positioning various layers of anti-ballistic protective materials in association with the first enclosure element.

Preferably, the first enclosure element includes a curved back portion. Preferably, the first enclosure element is formed with a raised peripheral edge.

Preferably, the various layers of anti-ballistic material include layers of unidirectional polyethylene. Preferably, the various layers of anti-ballistic material include at least one ceramic plate. Preferably, at least one side of the at least one ceramic plate is coated with a layer of Kevlar®. Additionally or alternatively, at least one side of the at least one ceramic plate is coated with a layer of fiberglass.

Additionally or alternatively, the various layers of anti-ballistic material includes at least one steel plate. Preferably, at least one side of the at least one steel plate is coated with a layer of Kevlar®. Additionally or alternatively, at least one side of the at least one steel plate is coated with a layer of fiberglass.

Preferably, the assembly also includes a protective vest, wherein the enclosure is inserted into a pocket of the protective vest. Additionally or alternatively, the enclosure is mounted in close proximity to an exterior of a motor vehicle.

Additionally or alternatively, the enclosure is mounted in close proximity to an exterior of a stationary structure.

There is yet further provided in accordance with still another preferred embodiment of the present invention a method of manufacturing an anti-ballistic protective assembly including providing a first enclosure element, positioning various layers of anti-ballistic protective materials in association with the first enclosure element into a cavity of a vacuum forming molding machine, positioning a layer of vacuum formable material over the various layers of anti-ballistic protective materials in association with the first enclosure element in the cavity of a vacuum forming molding machine, and operating the vacuum forming molding machine to vacuum form a second enclosure element integrally with first enclosure element and to compress the various layers of anti-ballistic protective material and to define an enclosure therefor, which retains the various layers of protective material in a compressed state in very tight mutual engagement.

In accordance with a preferred embodiment of the present invention, the method also includes preheating the first enclosure element prior to the positioning various layers of anti-ballistic protective materials in association therewith. Preferably, the method also includes mutually compressing the various layers of anti-ballistic protective materials prior to the positioning various layers of anti-ballistic protective materials in association with the first enclosure element into a cavity of a vacuum forming molding machine.

Preferably, the first enclosure element includes a curved back portion. Preferably, the first enclosure element is formed with a raised peripheral edge.

Preferably, the various layers of anti-ballistic material include layers of unidirectional polyethylene. Preferably, the various layers of anti-ballistic material include at least one ceramic plate. Preferably, at least one side of the at least one ceramic plate is coated with a layer of Kevlar®. Additionally or alternatively, at least one side of the at least one ceramic plate is coated with a layer of fiberglass.

Additionally or alternatively, the various layers of anti-ballistic material include at least one steel plate. Preferably, at least one side of the at least one steel plate is coated with a layer of Kevlar®. Additionally or alternatively, at least one side of the at least one steel plate is coated with a layer of fiberglass.

Preferably, the assembly also includes a protective vest, wherein the enclosure is inserted into a pocket of the protective vest. Additionally or alternatively, the enclosure is mounted in close proximity to an exterior of a motor vehicle. Additionally or alternatively, the enclosure is mounted in close proximity to an exterior of a stationary structure.

Additionally, operating the vacuum forming molding machine includes tightly engaging the layer of vacuum formable material with a sealing ring formed on the periphery of the cavity. Additionally, tightly engaging the layer of vacuum formable material is achieved by lowering a peripheral cover element onto the layer of vacuum formable material over the sealing ring.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
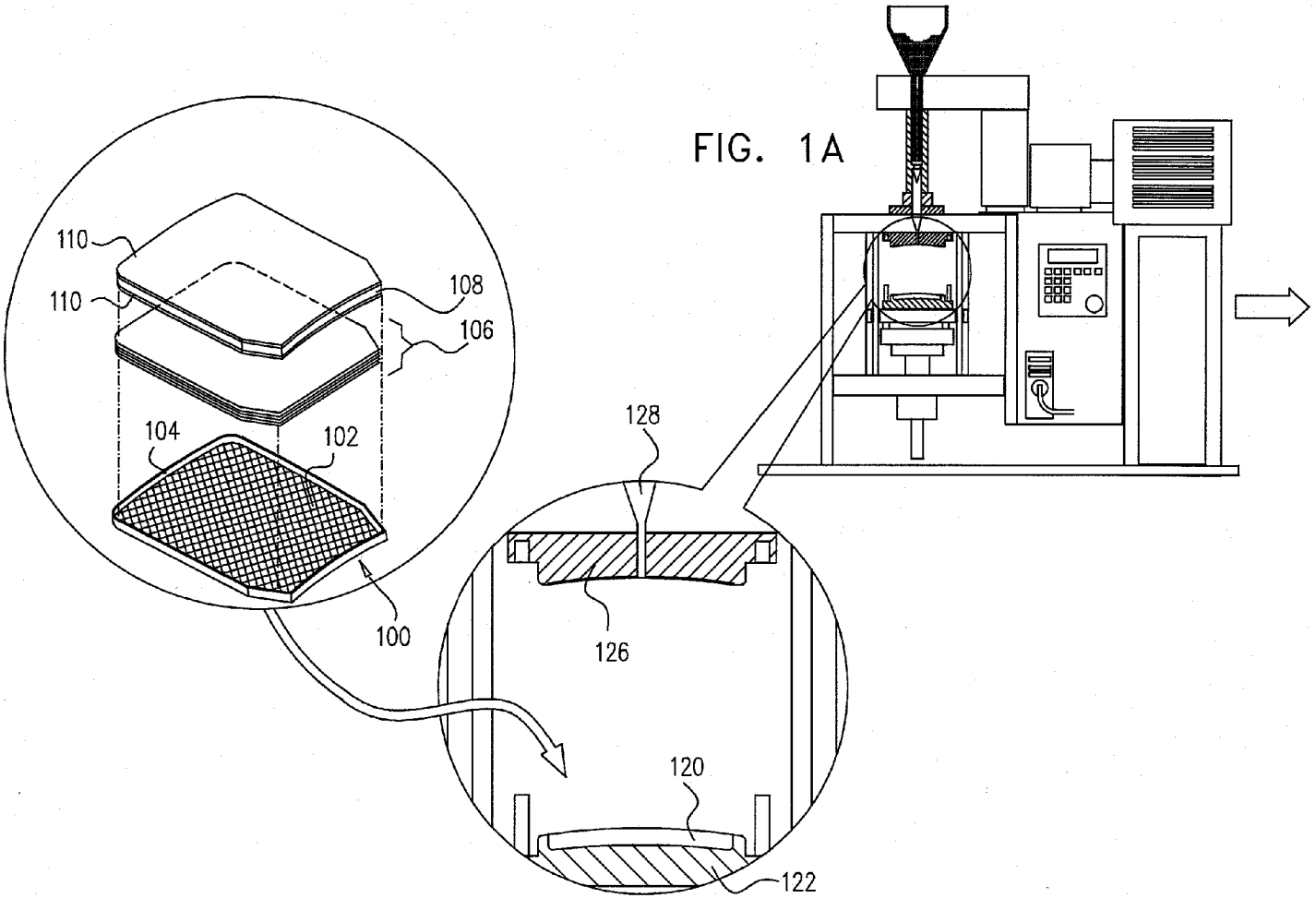
FIGS. 1A-1C are together a simplified illustration of a method of manufacturing an anti-ballistic protective assembly in accordance with a preferred embodiment of the present invention.
Figure 1B:
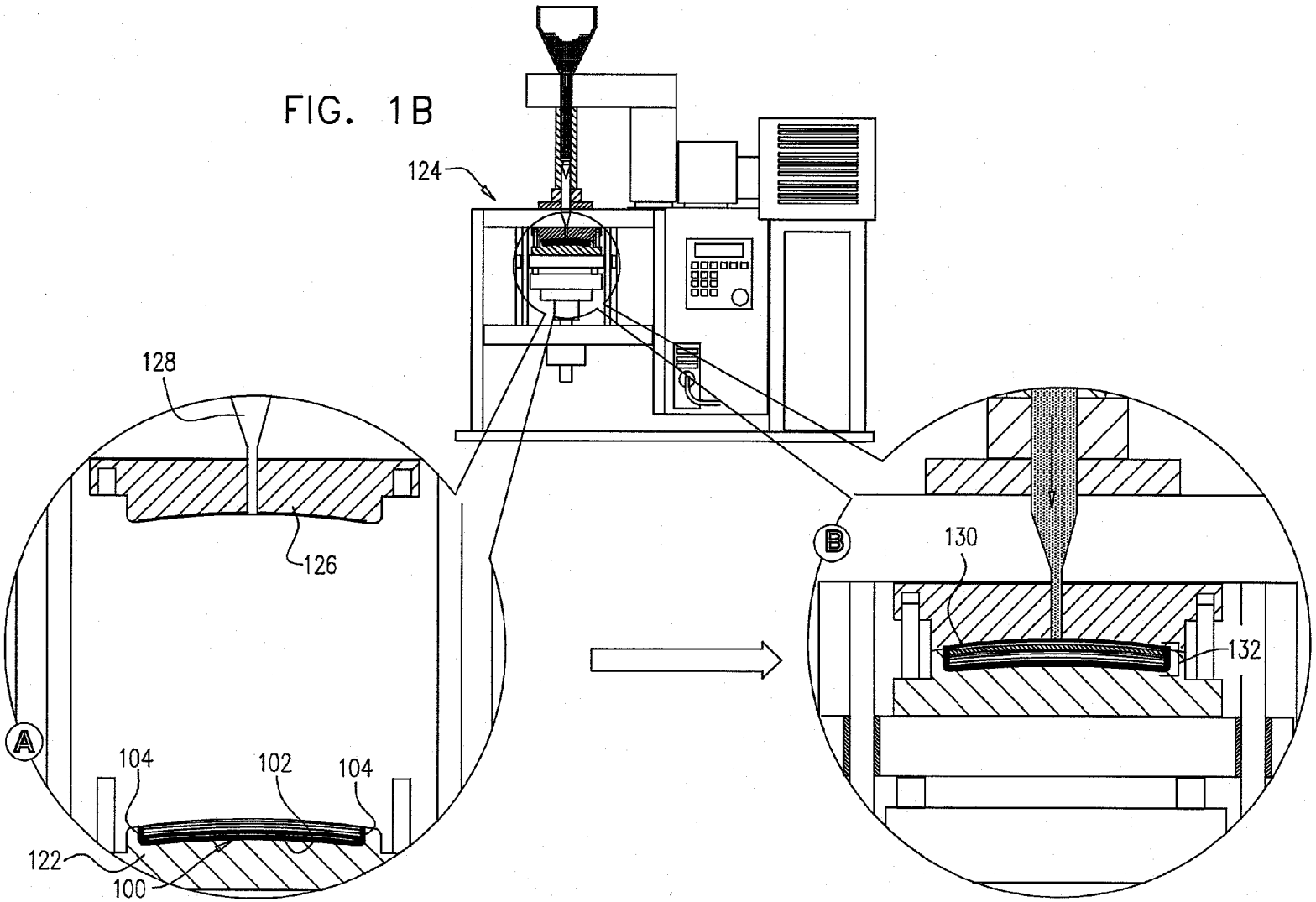
Figure 1C:
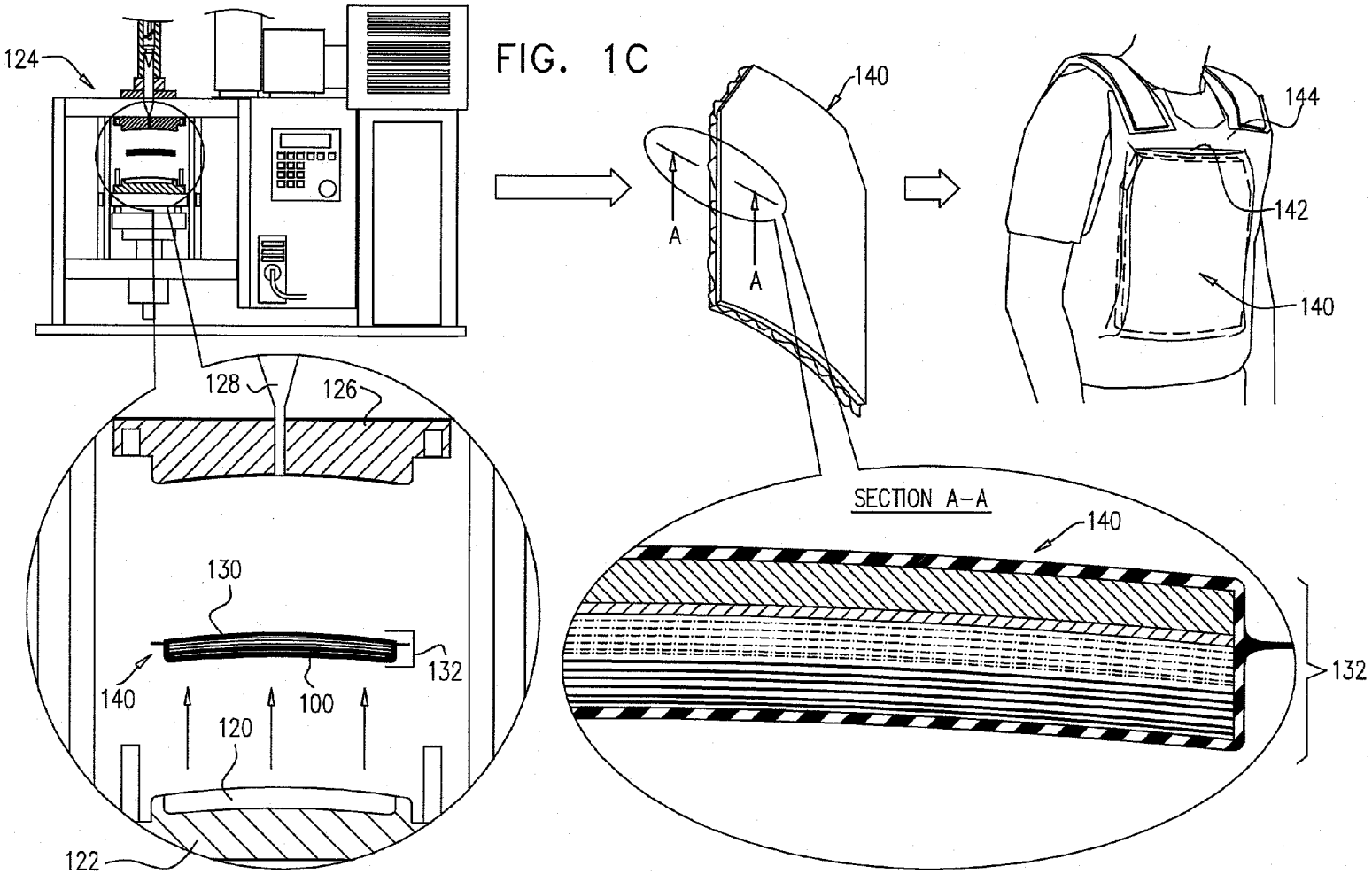

Reference is now made to FIGS. 1A-1C, which are together a simplified illustration of a method of manufacturing an anti-ballistic protective assembly in accordance with a preferred embodiment of the present invention, employing a conventional injection molding machine.

As seen in FIG. 1A, a pre-manufactured first enclosure element 100, having a preferably somewhat curved back portion 102 and a preferably raised peripheral edge 104 is provided, and various layers of anti-ballistic protective materials are positioned therein generally as shown. For example, the first enclosure element 100 can be a pre-manufactured first enclosure element having a raised peripheral edge defining a cavity on at least one side of said first enclosure element. In addition, the raised peripheral edge can surround a center portion of the first enclosure element and have a greater thickness than the center portion of the first enclosure element. The cavity of the first enclosure element can have a thickness the same as the thickness of the anti-ballistic protective materials or plurality of layers of the anti-ballistic material. The upper surface of the raised peripheral edge of the first enclosure element can integrally connect with the second enclosure element. For example, the second enclosure element is a sheet of uniform thickness and integrally connecting to the upper surface of the raised peripheral edge of the first enclosure element. Back portion 102 is preferably formed with polypropylene, ABS or other thermoplastic material, and is preferably comolded with Kevlar aramid fiber, commercially available form DuPont, of Wilmington, Del.

Alternatively, back portion 102 may be flat.

The layers of anti-ballistic protective materials preferably include multiple layers 106 of anti-ballistic fabrics, preferably layers of unidirectional polyethylene such as Dyneema® HB50 or Dyneema® HB80, commercially available from DSM of Urmond, Holland. Preferably 40-50 layers 106 are provided. A flat or shaped plate 108 preferably formed of ceramic material such as Alumina FG-98, SC-DS direct-sintered silicon carbide or Boron carbide reaction-bonded boron carbide, each of which is commercially available from Coorstek Inc. of Golden, Colo., is preferably also provided as shown. Alternatively, plate 108 may be formed of annealed steel such as annealed carbon steel strips of 1070 or 1075 SAE/ASI commercially available from Inac s.p.a, of Valmadrera, Italy, which annealed steel is hardened to a hardness of HRC 58-60 by a process comprising quenching and tempering. Preferably, both sides of plate 108 are coated with a layer of Kevlar® or fiberglass 110.

The first enclosure element 100 and the above-described layers of protective materials, positioned therein are placed, as shown in enlargement A of FIG. 1B, in a cavity 120 formed in a bottom portion 122 of a mold, which is installed in a conventional vertical injection molding machine 124, such as an ALLROUNDER 420 S vertical injection molding machine, commercially available from ARBURG GmbH of Lossburg, Germany. A top portion 126 of the mold, having an injection passageway 128 formed therein is also installed in the injection molding machine 124 and is arranged for operative engagement with bottom portion 122 during injection molding, shown in enlargement B of FIG. 1B.

Portions 122 and 126 of the mold are configured to injection mold a second enclosure element 130 integrally with first enclosure element 100, thereby to compress the layers of anti-ballistic protective material described hereinabove and to define a complete or nearly complete enclosure 132 therefor, which retains the various layers of protective material in a compressed state in very tight mutual engagement.

Alternatively, a horizontal injection molding machine may be employed to injection mold second enclosure element 130 integrally with first enclosure element 100, thereby to compress the layers of anti-ballistic protective material described hereinabove and to define a complete or nearly complete enclosure 132 therefor, which retains the various layers of protective material in a compressed state in very tight mutual engagement.

As seen in FIG. 1C, separation of portions 122 and 126 of the mold releases an antiballistic protective assembly 140 comprising enclosure 132 which tightly encloses the mutually compressed various layers of protective material in very tight mutual engagement. The edges of the antiballistic protective assembly 140 are preferably trimmed as needed by any suitable technique and the assembly may be inserted into a pocket 142 of a protective vest 144 as shown. Alternatively, antiballistic protective assembly 140 may be of various sizes and may be utilized, for example, for antiballistic protection of motor vehicles and stationary structures.

Reference is now made to FIGS. 2A-2F, which are together a simplified illustration of a method of manufacturing an anti-ballistic protective assembly in accordance with another preferred embodiment of the present invention, employing a conventional vacuum forming molding machine.

Figure 2A:
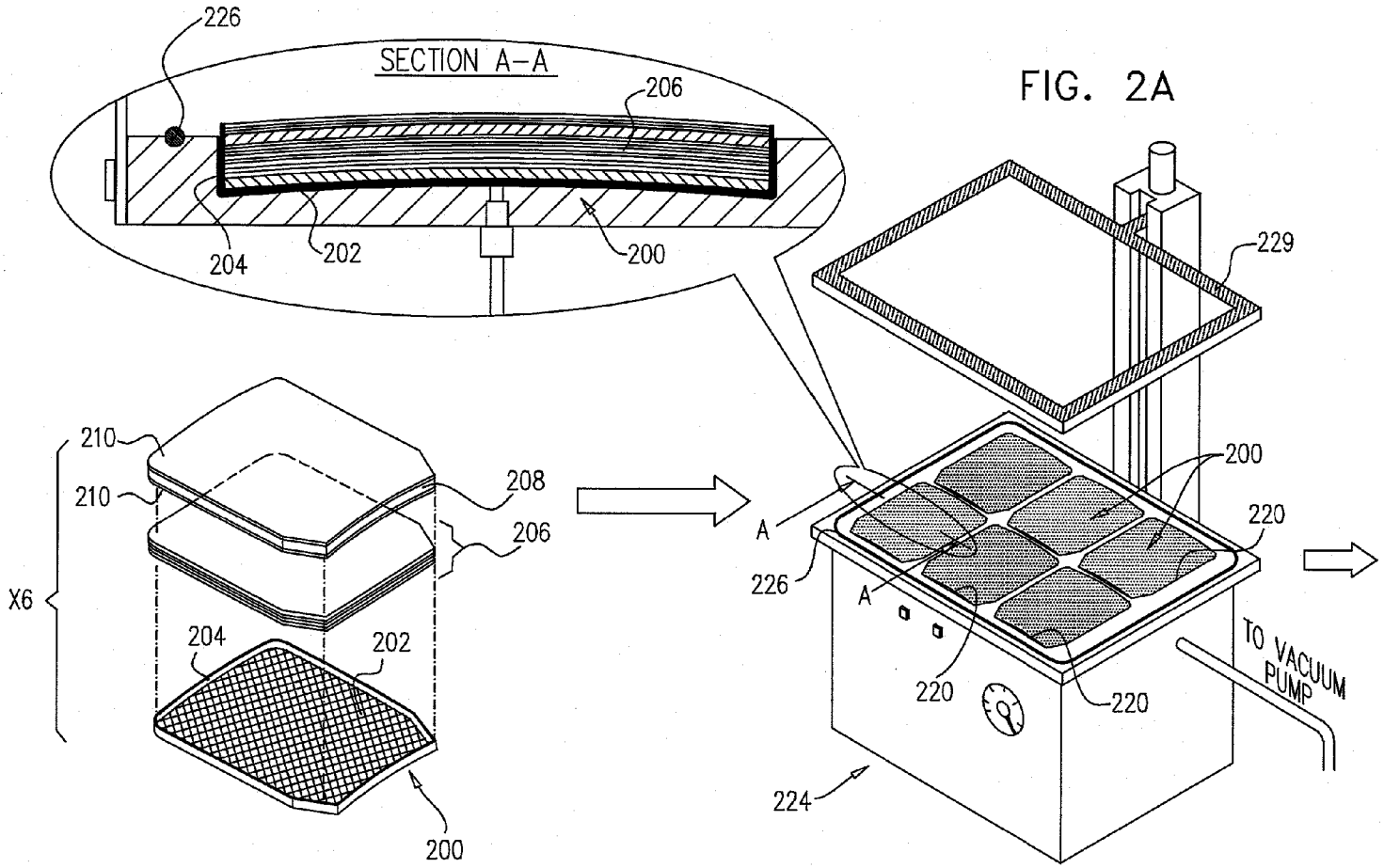
FIGS. 2A-2F are together a simplified illustration of a method of manufacturing an anti-ballistic protective assembly in accordance with another preferred embodiment of the present invention.

As seen in FIG. 2A, a plurality of pre-manufactured first enclosure elements 200, each having a preferably somewhat curved back portion 202 and a preferably raised peripheral edge 204 are provided, and various layers of anti-ballistic protective materials are positioned in each of the first enclosure elements 200 generally as shown. Back portion 202 is preferably formed with polypropylene, ABS or other thermoplastic material, and is preferably comolded with Kevlar® aramid fiber, commercially available from DuPont, of Wilmington, Del.

Alternatively, back portion 202 may be flat.

The layers of anti-ballistic protective materials preferably include multiple layers 206 of anti-ballistic fabrics, preferably layers of unidirectional polyethylene such as Dyneema® HB50 or Dyneema® HB80, commercially available from DSM of Urmond, Holland. Preferably 40-50 layers 206 are provided. A flat or shaped plate 208 preferably formed of ceramic material such as Alumina FG-98, SC-DS direct-sintered silicon carbide or Boron carbide reaction-bonded boron carbide, each of which is commercially available from Coorstek Inc. of Golden, Colo. is preferably also provided as shown. Alternatively, plate 208 may be formed of annealed steel such as annealed carbon steel strips of 1070 or 1075 SAE/ASI, commercially available from Inac s.p.a, of Valmadrera, Italy, which annealed steel is hardened to a hardness of HRC 58-60 by a process comprising quenching and tempering. Preferably, both sides of plate 208 are coated with a layer of Kevlar or fiberglass 210. Preferably, layers 206 and plate 208 are mutually compressed.

The plurality of first enclosure elements 200 each containing the above-described layers of protective materials, positioned therein, are placed, as shown FIG. 2A, in a plurality of vacuum forming cavities 220 formed in a conventional vacuum forming molding machine 224, which are surrounded by a vacuum sealing ring 226. The vacuum forming molding machine 224 may be, for example, a Model BV-E-Class Manual Sheet Fed Vacuum Former, commercially available from Bel-O-Vac of Banning, Calif.

Figures 2B, 2C:
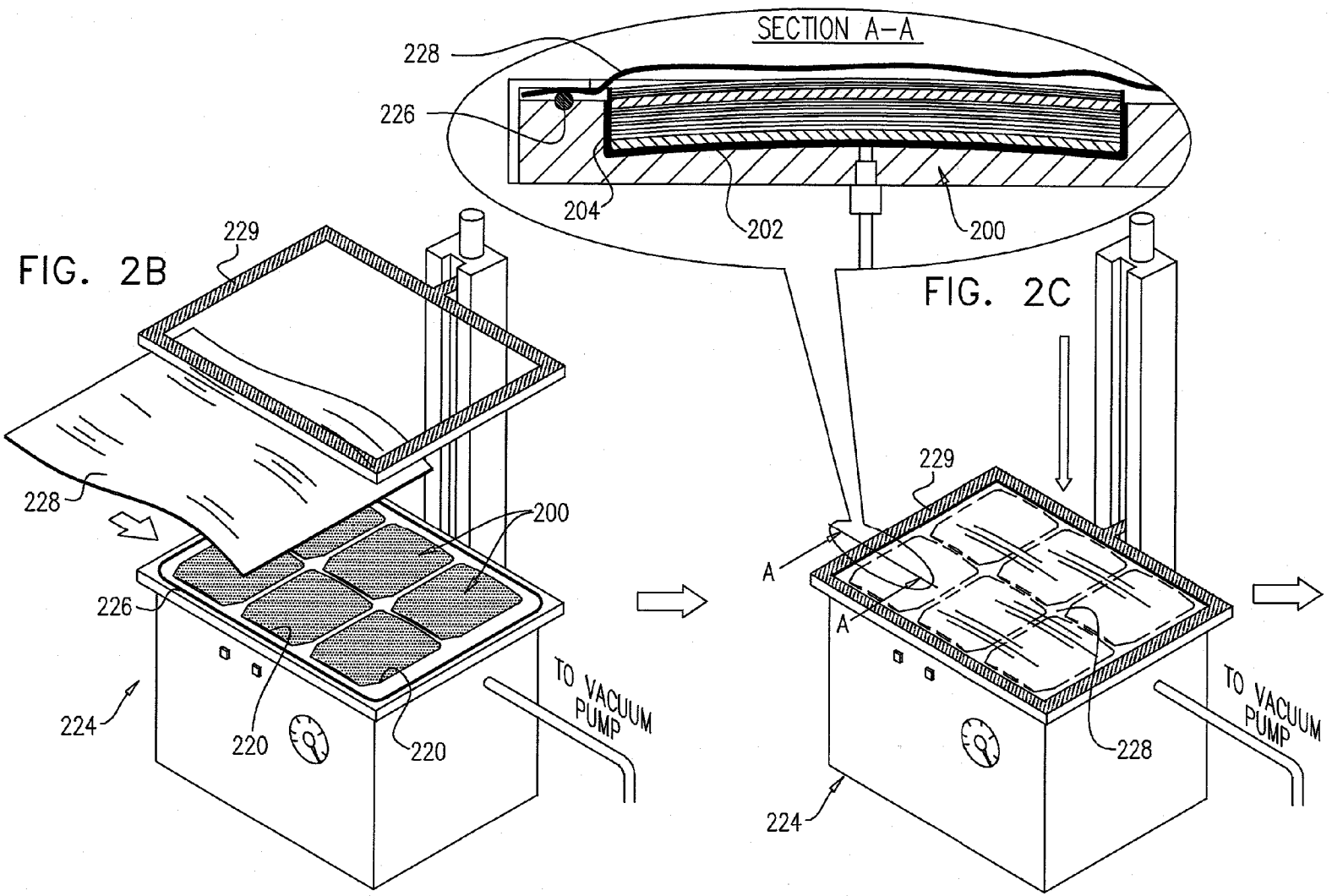

Preferably, an adhesive epoxy is applied to edge 204 of each of enclosure elements 200. As seen in FIG. 2B, sheet 228 of vacuum formable material, such as an ABS sheet, is placed over cavities 220, containing the first enclosure elements 200 and the above-described layers of protective materials and sealing ring 226 and a peripheral cover element 229 is lowered onto sheet 228 over sealing ring 226, bringing the sheet 228 into vacuum sealing engagement with sealing ring 226, as seen in FIG. 2C.

Figures 2D, 2E:
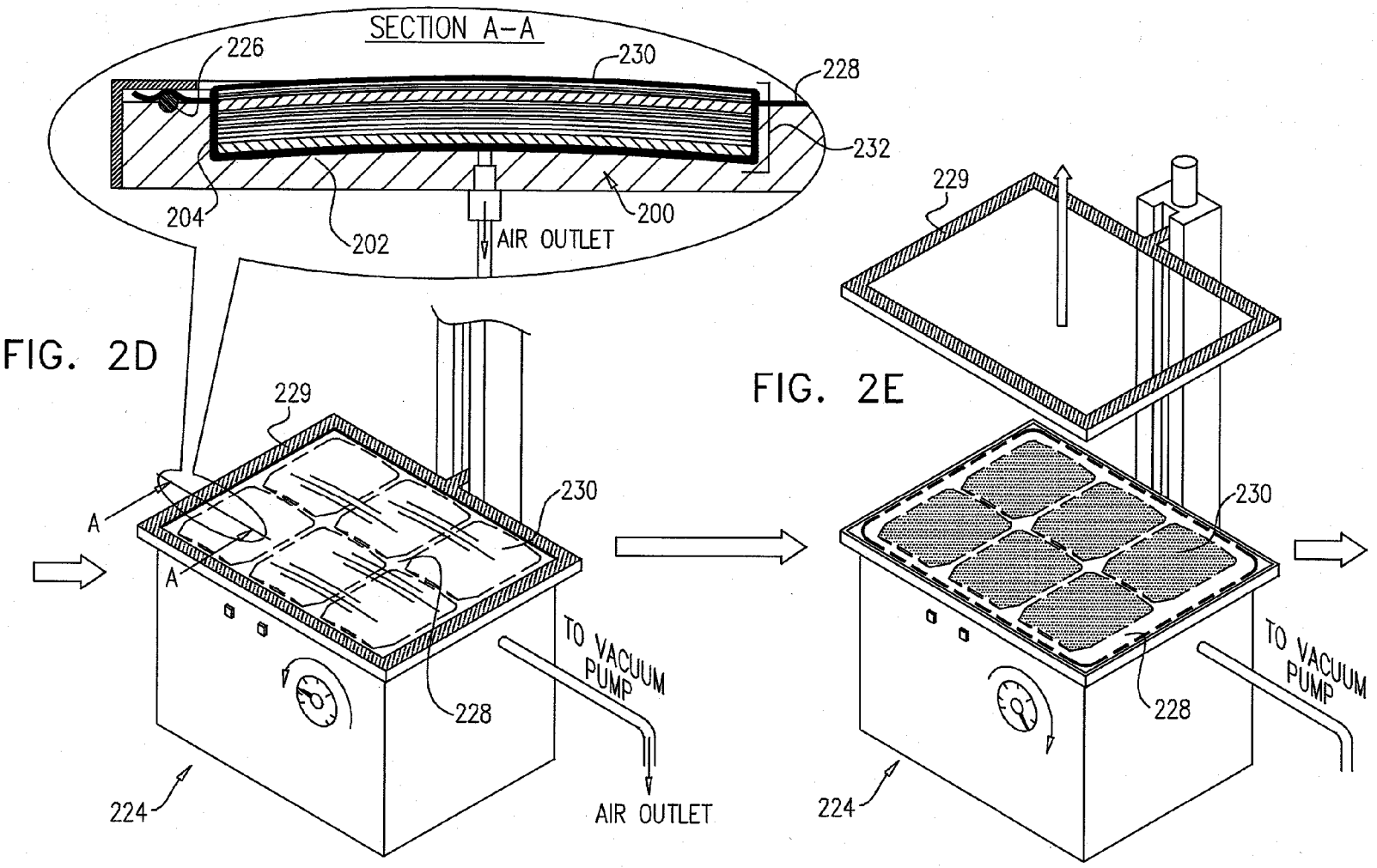

As seen in FIG. 2D, vacuum is then applied to the cavities 220, containing the first enclosure elements 200 and the above-described layers of protective materials, drawing sheet 228 into tight vacuum engagement therewith, compressing the layers of protective materials against the respective first enclosure elements 200. Suitable heating of sheet 228 and of the first enclosure elements 200 welds the sheet 228 to the peripheries of the first enclosure elements 200 in cavities 220 by adhesively engaging with edges 204 of each of enclosure elements 200, thereby defining second enclosure elements 230 integrally formed with first enclosure elements 200 and defining complete or nearly complete enclosures 232 for the layers of anti-ballistic protective material described hereinabove, which retains the various layers of protective material in a compressed state in very tight mutual engagement.

Figure 2F:
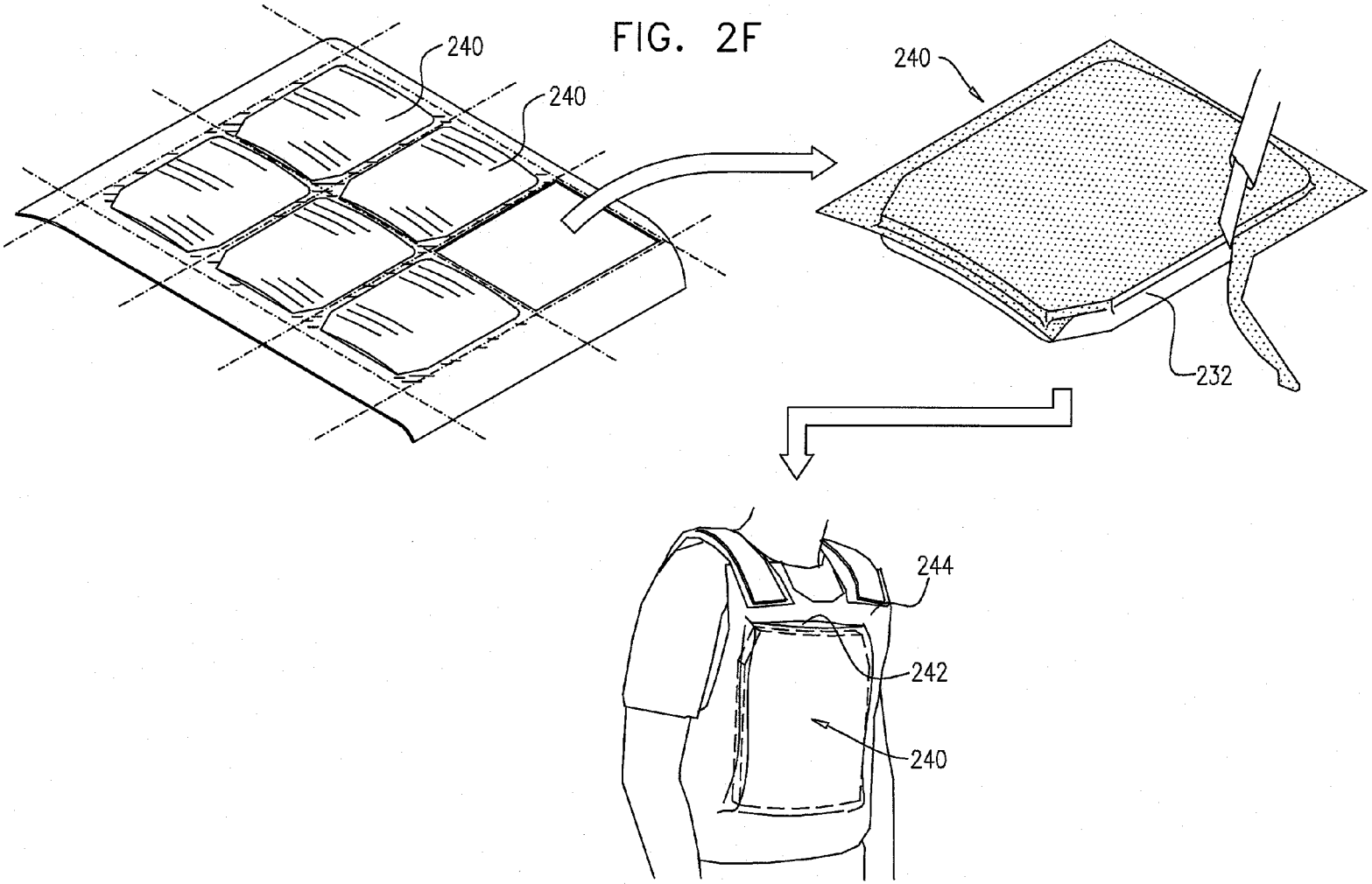

As seen in FIG. 2E, raising of the peripheral cover element 229 enables removal of a plurality of joined together antiballistic protective assemblies 240, shown in FIG. 2F, each comprising an enclosure 232 which tightly encloses the various layers of protective material in a compressed state in very tight mutual engagement. Separation and trimming of the protective assemblies 240 may be carried out by any suitable technique and the assembly may be inserted into a pocket 242 of a protective vest 244 as shown in FIG. 2F. Alternatively, antiballistic protective assembly 140 may be of various sizes and may be utilized, for example, for antiballistic protection of motor vehicles and stationary structures.

It will be appreciated by persons skilled in the art that the present invention is not limited to what has been particularly shown and described hereinabove. Rather the scope of the present invention includes both combinations and subcombinations of various features described hereinabove as well as modifications thereof which would occur to persons skilled in the art upon reading the foregoing description and which are not in the prior art.

The invention claimed is:

1. An anti-ballistic protective assembly, comprising:

a pre-manufactured first enclosure element having a raised peripheral edge defining a cavity on at least one side of said first enclosure element;

a plurality of layers of anti-ballistic material disposed within said cavity of said first enclosure element, said plurality of layers comprising at least a first layer comprising at least a first anti-ballistic material and a second layer comprising a second anti-ballistic material different from said first anti-ballistic material; and a second enclosure element which is injection molded or vacuum formed integrally with said first enclosure element to form an enclosure and to compress said plurality of layers of anti-ballistic material and maintain said plurality of layers of anti-ballistic material in a compressed state within the enclosure.

2. The anti-ballistic protective assembly according to claim 1, wherein said plurality of layers of anti-ballistic material further comprises layers of unidirectional polyethylene.

3. The anti-ballistic protective assembly according to claim 1, wherein said plurality of layers of anti-ballistic material comprises at least one plate made of ceramic or steel.

4. The anti-ballistic protective assembly according to claim 3, wherein at least one side of said at least one plate is coated with a layer of Kevlar® or fiberglass.

5. The anti-ballistic protective assembly according to claim 1, further comprising a protective vest having a pocket into which said enclosure is configured to be inserted.

6. The anti-ballistic protective assembly according to claim 1, wherein said enclosure is mounted in close proximity to an exterior of a motor vehicle or a stationary structure.

7. The anti-ballistic protective assembly according to claim 1, wherein said plurality of layers of anti-ballistic material are completely enclosed within said enclosure.

8. A method of manufacturing an anti-ballistic protective assembly, comprising:

providing a pre-manufactured first enclosure element having a raised peripheral edge defining a cavity on at least one side of said first enclosure element;

positioning layers of anti-ballistic protective materials into the cavity of said first enclosure element;

positioning said first enclosure element into a cavity of a injection molding machine; and operating said injection molding machine to injection mold a second enclosure element integrally with first enclosure element to compress said layers of anti-ballistic protective material and to define an enclosure thereof, which maintains said layers of protective material in a compressed state.

9. The method of manufacturing an anti-ballistic protective assembly according to claim 8, further comprising mutually compressing said layers of anti-ballistic protective materials prior to said positioning layers of anti-ballistic protective materials into said cavity of said first enclosure element.

10. The method of manufacturing an anti-ballistic protective assembly according to claim 8, further comprising preheating said first enclosure element prior to said positioning layers of anti-ballistic protective materials in association therewith.

11. The method of manufacturing an anti-ballistic protective assembly according to claim 8, further comprising mutually compressing said layers of anti-ballistic protective materials prior to said positioning layers of anti-ballistic protective materials in association with said first enclosure element into a cavity of a vacuum forming molding machine.

12. The method of manufacturing an anti-ballistic protective assembly according to claim 8, further comprising inserting said enclosure into a pocket of a protective vest.

13. An anti-ballistic protective assembly according to claim 8, further comprising mounting said enclosure in close proximity to an exterior of a motor vehicle or of a stationary structure.

14. A method of manufacturing an anti-ballistic protective assembly, comprising:

providing a pre-manufactured first enclosure element having a raised peripheral edge defining a cavity on at least one side of said first enclosure element;

positioning layers of anti-ballistic protective materials into said first enclosure element;

positioning said pre-manufactured first enclosed element into a cavity of a vacuum forming molding machine;

positioning a layer of vacuum formable material over said layers of anti-ballistic protective materials in association with said first enclosure element in said cavity of a vacuum forming molding machine; and operating said vacuum forming molding machine to vacuum form a second enclosure element integrally with said first enclosure element to compress said layers of anti-ballistic protective material and to define an enclosure thereof, which maintains said layers of protective material in a compressed state.

15. The method of manufacturing an anti-ballistic protective assembly according to claim 14, further comprising preheating said first enclosure element prior to said positioning layers of anti-ballistic protective materials into said cavity of the first enclosure element.

16. The method of manufacturing an anti-ballistic protective assembly according to claim 14, further comprising mutually compressing said layers of anti-ballistic protective materials prior to said positioning layers of anti-ballistic protective materials in association said first enclosure element into a cavity of a vacuum forming molding machine.

17. The method of manufacturing an anti-ballistic protective assembly according to claim 14, further comprising inserting said enclosure into a pocket of a protective vest.

18. The method of manufacturing an anti-ballistic protective assembly according to claim 14, wherein said operating said vacuum forming molding machine comprises tightly engaging said layer of vacuum formable material with a sealing ring formed on the periphery of said cavity.

19. The method of manufacturing an anti-ballistic protective assembly according to claim 18, wherein said tightly engaging said layer of vacuum formable material comprises lowering a peripheral cover element onto said layer of vacuum formable material over said sealing ring.

20. An anti-ballistic protective assembly, comprising:

a pre-manufactured first enclosure element having a raised peripheral edge defining a cavity on one side of said first enclosure element, the raised peripheral edge surrounding a center portion of the first enclosure element and having a greater thickness than the center portion of the first enclosure element;

a plurality of layers of anti-ballistic material disposed within said cavity of said first enclosure element, said plurality of layers comprising layers of at least two anti-ballistic materials; and a second enclosure element which is injection molded or vacuum formed integrally with the raised peripheral edge of the first enclosure element to form an enclosure and compress the plurality of layers of anti-ballistic material and maintain said plurality of layers of anti-ballistic material in a compressed state.

21. The assembly according to claim 20, wherein a thickness of the cavity of the first enclosure member is same as a thickness of the plurality of layers of anti-ballistic material.

22. The assembly according to claim 21, wherein the second enclosure element encloses the cavity of the first enclosure element to capture and compress the plurality of layers of anti-ballistic material.

23. The assembly according to claim 22, wherein the second enclosure element is formed as a sheet integrally connecting to an upper surface of the raise peripheral edge of the first enclosure element.

* * * * *